United States Patent [19]

Slemon et al.

[11] Patent Number: 5,049,855

[45] Date of Patent: Sep. 17, 1991

[54] SECURITY SCREEN SYSTEM

[76] Inventors: Charles S. Slemon, 1130 Island View La., Encinitas; William M. Lafferty, 571 D Hygeia Ave., Leucadia, both of Calif. 92024; Clark C. Guest, 11524 Alkaid Dr., San Diego, Calif. 92126; Anthony E. Diamond, 6348 Caminito Partida, San Diego, Calif. 92111; Daniel S. Kline, 1768 Butters Rd., Carlsbad, Calif. 92008

[21] Appl. No.: 425,866

[22] Filed: Oct. 24, 1989

[51] Int. Cl.[5] ..... G08B 13/00

[52] U.S. Cl. ..... 340/550; 250/227.28

[58] Field of Search ..... 340/550; 250/227.11-227.32

[56] References Cited

U.S. PATENT DOCUMENTS

| | | | |
|---|---|---|---|
| 3,051,935 | 8/1962 | Willson | 340/550 |
| 3,696,373 | 10/1972 | Dunn et al. | 340/550 X |
| 3,863,242 | 1/1975 | Minton | 340/550 |
| 4,146,293 | 3/1979 | Mutton et al. | 340/550 |
| 4,232,310 | 11/1980 | Wilson | 340/550 |
| 4,234,875 | 11/1980 | Williams | 340/550 |
| 4,293,778 | 10/1981 | Williams | 340/550 X |
| 4,367,460 | 1/1983 | Hodara | 340/550 |
| 4,399,430 | 8/1983 | Kitchen | 340/550 |
| 4,538,527 | 9/1985 | Kitchen | 340/550 X |
| 4,586,030 | 4/1986 | Klostermann | 340/550 |
| 4,676,485 | 6/1987 | Ciordinik et al. | 256/12 |
| 4,680,573 | 7/1987 | Ciordinik et al. | 340/541 |
| 4,814,750 | 3/1989 | Abramson | 340/550 |
| 4,847,596 | 7/1989 | Jacobson et al. | 340/550 |

FOREIGN PATENT DOCUMENTS

| | | | |
|---|---|---|---|
| 2038060 | 7/1980 | United Kingdom | 340/550 |
| 2046971 | 11/1980 | United Kingdom | 340/550 |
| 1602112 | 11/1981 | United Kingdom | 340/550 |

*Primary Examiner*—Glen R. Swann, III
*Assistant Examiner*—Thomas J. Mullen, Jr.
*Attorney, Agent, or Firm*—Brown, Martin, Haller & McClain

[57] ABSTRACT

A security screen assembly comprises a screen of mesh material with an optical path formed from at least one optical fiber integrally interwoven with the screen material in a generally serpentine path. A light source or transmitter is coupled to the first end of the optical path while a suitable light detector is coupled to detect light emitted from the second end of the optical path. An interface unit connects the screen to a remote alarm control unit for activating an alarm if the detected light signal falls below a predetermined intensity.

18 Claims, 6 Drawing Sheets

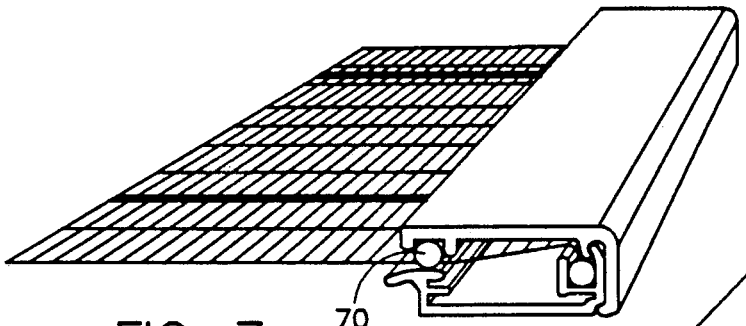
FIG. 7
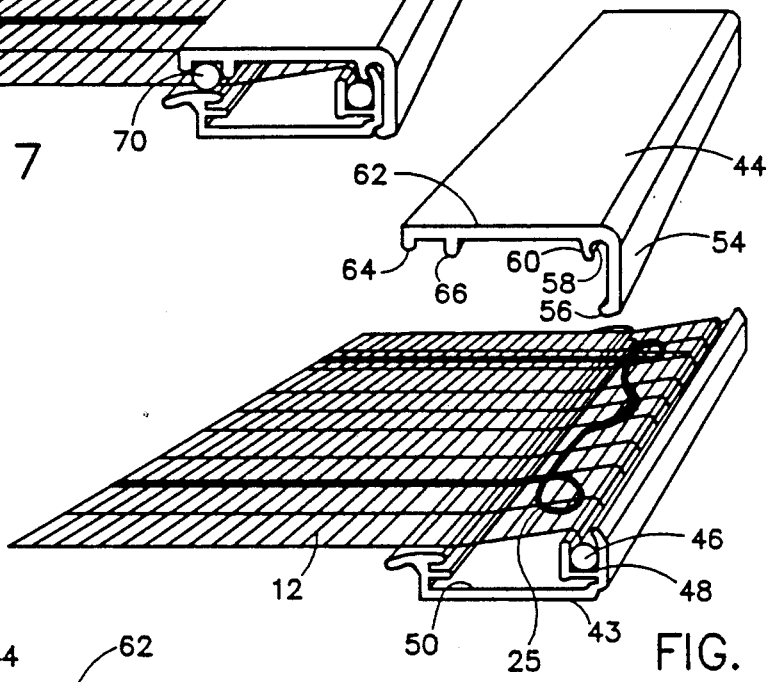
FIG. 6
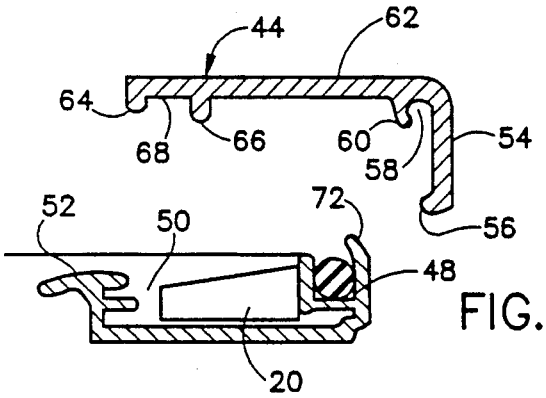
FIG. 8A
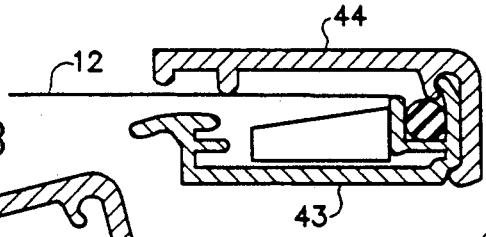
FIG. 8C
FIG. 8B
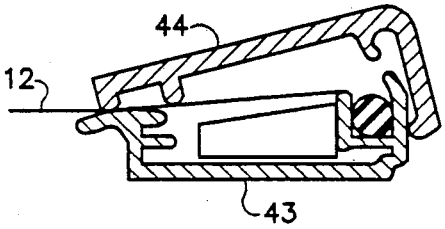
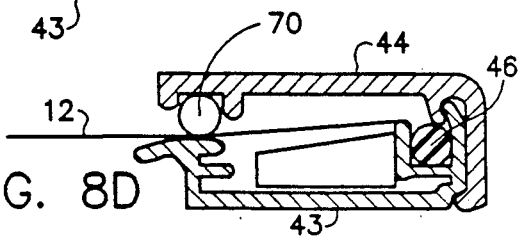
FIG. 8D

SECURITY SCREEN SYSTEM

BACKGROUND OF THE INVENTION

The present invention relates generally to security screen systems for windows and doors in both residential and commercial buildings.

Known security screen systems consist of a sensing wire woven into or bonded to the fabric of an existing door or window screen and connected to a suitable circuit for detecting if the screen is cut or removed and for activating an alarm if this occurs. These systems are subject to some disadvantages in that the copper sensing wire can become corroded as a result of exposure to the external environment, resulting in malfunctions. Also, the wire can sometimes be stretched enough to allow an intruder to open the window or door without activating the alarm. Additionally, such screens are sensitive to electromagnetic interference which can give false alarms, and can be bypassed relatively easily by someone with an elementary understanding of electricity and circuits.

Other security panels incorporating optical fibers have been proposed in the past. These panels may either be specially constructed, or are formed by gluing or interweaving a plurality of optical fibers onto an existing screen or panel, with an optical emitter and detector at the opposite ends of each fiber. Alternatively, additional lengths of optical fiber are used to bring all the spaced fiber ends to a common source and detector location. Both these arrangements are relatively complex and therefore expensive.

SUMMARY OF THE INVENTION

It is an object of this invention to provide an improved security screen and security screen system.

According to one aspect of the present invention, a security screen or panel is provided which comprises a woven mesh screen for covering a window or door opening, a continuous optical path comprising at least one optical fiber extending in a generally serpentine path across the screen and interwoven with the screen material, a light emitter connected to transmit light along the path, and a light detector connected to detect light emitted from the fiber path. The path may be formed by a single continuous optical fiber woven into the screen material, or a plurality of spaced optical fibers may be woven into the screen material in place of spaced wires in the screen, with suitable optical splice members connecting the ends of the fibers together in pairs to form a continuous light path through all the fibers.

In one embodiment of the invention, the optical fibers are interwoven with the screen material, replacing several equally spaced strands of standard screen material, such as metal or plastic wire. Alternatively, a single optical fiber replaces several wires in the screen. The latter alternative may be achieved by tying the end of an optical fiber to an end of one of the wires in the screen, pulling the wire from the other end through the screen so as to thread the optical fiber in one direction across the screen, then tying the fiber to the end of another, spaced wire in the screen, pulling that wire through the screen to thread the fiber in the other direction across the screen, and so on until the fiber extends through the entire screen with adjacent sections at the desired spacing, normally of the order of about 4 inches. Since the or each optical fiber is actually interwoven with the screen material, it will be less noticeable, and the risk of the fibers being accidentally or intentionally dislodged is reduced. The emitter may be coupled to one end of the path while the detector is coupled to the opposite end. Alternatively, a reflective surface may be provided at one end of the path while both the emitter and the detector are coupled to the opposite end of the path.

Preferably, the light transmitter and detector form part of an electro-optic module or control circuit for operating the transmitter to transmit light into the fibers and for coupling to an alarm control unit for producing an alarm signal in the event of any deviation of the detected light signal outside predetermined limits, as would result, for example, if any of the fibers are bent significantly or cut, reducing the strength of the detected light signal or blocking the signal path altogether. In the preferred embodiment of the invention, the electro-optic module is designed to interface to existing security system control or alarm units designed to be connected to standard wire security screens. Such control units are designed to produce an alarm signal in the event of an open circuit condition, resulting from a wire being cut or the screen being removed. In order to mimic this open circuit condition, the electro-optic module includes a switch for connection across the control unit sensor inputs in place of the current wire screen. The switch is designed to be opened in the event of detection of a change in the light signal outside predetermined limits. The switch may be a transistor or an opto-mechanical switch. Preferably, the control circuit includes a pulser/synchronizer circuit for producing pulses of light at the transmitter for coupling into the optical fibers, so as to reduce the power required.

In a preferred embodiment of the invention, the edges of the screen are mounted in a frame which also houses the opto-electronic module adjacent the first edge of the screen. The frame is of generally rectangular shape and is formed in two halves which are designed to snap together to retain the screen edges. The frame has an internal space or chamber providing sufficient space to house the splice members and electro-optic module. Alternatively, the electro-optical module may be located at or inside the alarm control unit housing, with one or more optical fiber connections extending from the panel to the control unit. At the point where the screen material enters the frame, the frame comprises a gently curved surface on one side and a resilient or elastic member on the opposite side, to avoid sharp flexing of the fibers which could lead to fatigue or failure.

Preferably, each fiber is looped at one of its ends prior to splicing to another fiber end, the loop being slightly larger than the minimum size allowed for fiber reliability. This allows some slack or free play in the fibers to avoid alarm signals resulting from normal everyday use of the frame. At the same time, excessive force on the screen will pull the loops so that their radius is decreased to a point where the fiber snaps. The force required to snap a fiber which is looped in this way is much less than that required to tear a fiber by pulling on its ends. Thus, looping of the fibers will increase the sensitivity of the screen to forces above a predetermined limit.

The security screen or panel is simple and inexpensive, and can be coupled to an existing alarm control unit in place of a standard wire screen, also reducing expense. The screen is reliable and offers greater resistance to corrosion and tampering than existing electrical wire type security screens.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which:

FIG. 6 is a perspective view of a portion of the screen and frame of FIG. 1, with opposite halves of the frame separated;

FIG. 7 is a view similar to FIG. 6 with the frame parts clamped together to secure the screen edge;

FIG. 8A is a cross section through the edge of the screen and the frame with the frame halves separated;

FIGS. 8B to 8D are views similar to FIG. 8A illustrating the connection of the frame halves;

DESCRIPTION OF THE PREFERRED EMBODIMENT

Figure 1:
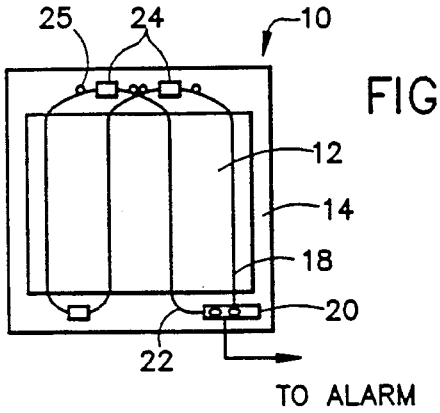
FIG. 1 is a diagrammatic front elevational view of a security panel according to one embodiment of the present invention, with all the screen material except for the optical fiber path omitted for clarity.
Figure 3:
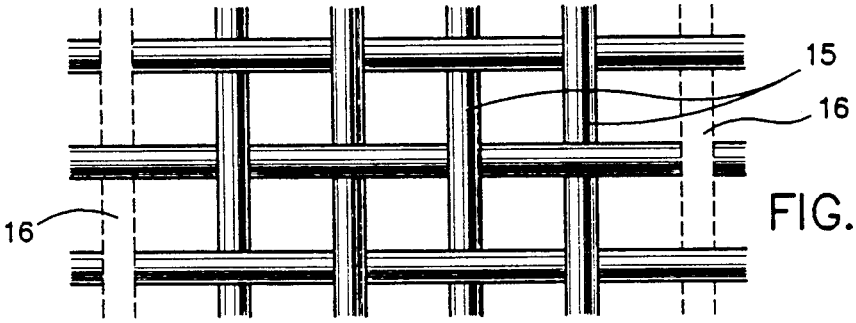
FIG. 3 is a view of a portion of the screen material in either of the two embodiments illustrated in FIGS. 1 and 2 on an enlarged,, scale illustrating the interweaving of the optical fibers with the screen material strands.

FIG. 1 illustrates a security screen assembly or panel 10 according to a first embodiment of the present invention adapted to be connected to an alarm system for activating an alarm in the event of detection of any tampering with the screen. The panel basically comprises a screen 12 of woven material with its outer edges secured in a peripheral frame 14. Parallel optical fibers 16 are interwoven at equally spaced intervals in the screen material 15 itself, as best illustrated in FIG. 3, in a similar manner to the interweaving of strands of electrically conductive wires in standard electrical security screens. Thus, strands of the screen material at regular intervals are omitted and replaced with optical fibers in the weaving process. In the subsequent standard heat treatment of the screen, the fibers can be made to become integrally molded into the screen material so that they will be virtually impossible to tamper with or remove without activating an alarm. This may be done by coating the fiber with a suitable material such as plastic, if necessary. The fiber used may be any standard optical fiber from single mode to plastic clad multi-mode fiber. A greater or lesser number of fibers than illustrated in the drawings may be used, according to the degree of sensitivity required. There must be an even total number of fibers to allow the fibers to be coupled in pairs as described below. Preferably, fibers are provided at a spacing of approximately four inches.

A first end 18 of a first one of the fibers is coupled to a transceiver or electro-optic module 20 which is mounted within the frame 14, and a first end 22 of a second, adjacent fiber is also connected to module 20. The remaining free ends of the fibers at the opposite edges of the screen are joined together in pairs via optical splice members 24 to form a continuous, generally serpentine optical path between the first end 18 of the first fiber and the first end 22 of the second fiber. The ends of immediately adjacent fibers may be connected together, or alternate fiber ends may be connected as illustrated in FIG. 1 to reduce the amount of bending of the fiber ends required to make the connection.

As illustrated in FIGS. 1 and 6, each fiber is looped at least at one of its ends prior to splicing to form a so-called "break loop" 25 which is carefully dimensioned to be slightly larger than the minimum size allowed for fiber reliability, which will be dependent on the particular fiber being used.

Figure 4:
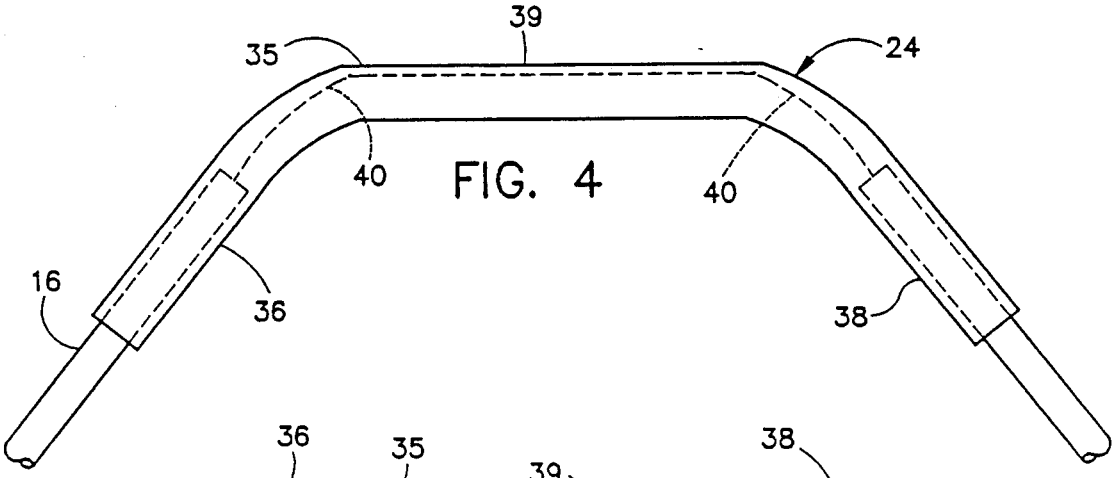
FIG. 4 is a side view on an enlarged scale of one of the splice members used to connect a pair of fiber ends together in the embodiment of FIG. 1.
Figure 5:
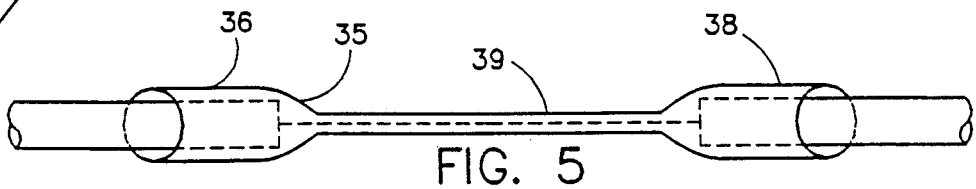
FIG. 5 is a top plan view of the splice member, also on an enlarged scale.

One of the splice members 24 of FIG. 1 is illustrated in more detail in FIGS. 4 and 5 of the drawings. As illustrated, each splice member preferably comprises a length of metal tubing 35 similar to a hypodermic needle and of diameter just larger than the buffering on the fiber. The tubing 35 is bent into a general U-shape with outwardly angled legs 36,38 and a relatively straight central section 39. The central section 39 of the tube is compressed or collapsed as illustrated in FIG. 5. In order to connect two fiber ends together using the splice member 24, the buffering is first removed for a short distance from each fiber end, leaving bare fiber 40. The fiber ends are made optically flat and perpendicular to the fiber by polishing or cleaving, and then inserted into the respective angled legs of the tubing 35. The angled legs cause each fiber end to force itself against the top inside edge of the tube as illustrated in FIG. 4. The fibers meet in the compressed central section 39 of the tube and are forced into proper alignment by the flattened walls of the tube in this area. The ends of the tube may be crimped slightly onto the underlying buffer layer of the fiber to retain the fibers in position. If desired, the tube may be filled with a clear epoxy resin matching the index of the optical fibers prior to inserting the fibers. The fibers are then introduced in the manner described above. The tube ends will be crimped in this case to provide mechanical support while the epoxy is curing. This splice member is significantly simpler and less expensive than standard fiberoptic splices.

Figure 2:
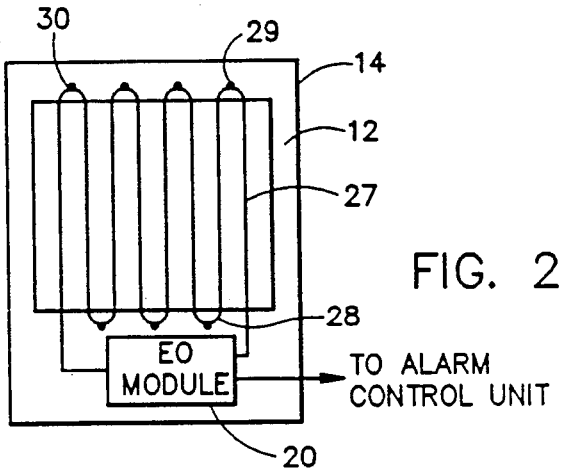
FIG. 2 is a view similar to FIG. 1 illustrating an alternative embodiment in which a single optical fiber is used.

FIG. 2 illustrates a modified embodiment in which a single optical fiber 27 is woven into the screen material to avoid the need for optical splices, reducing expense and also reducing optical losses in the optical path. This embodiment may be constructed by tying the end of fiber 27 to an end of one of the existing screen wires at one edge of the screen, pulling the opposite end of the wire to pull the wire through to the opposite side edge of the screen, simultaneously threading the optical fiber through the screen to follow the same path as the wire. The wire is then discarded, and the optical fiber end is then secured to another, spaced wire at the opposite edge of the screen. The second wire is then pulled through at the first edge, threading the wire back through the screen in the opposite direction. This procedure is repeated until the fiber has been threaded in a generally serpentine path across the entire screen. Sufficient free play is left at the bends 28 to allow break loops 29 to be formed at each turn in the wire. The embodiment of FIG. 2 is otherwise identical to that of FIG. 1, and the single optical fiber will be connected at its opposite ends to the electro-optics module 20 in the same way as the free ends of the spliced fibers in the FIG. 1 embodiment.

In each of the embodiments of FIGS. 1 and 2, short tubes 30 may be placed over the overlapping wire sections at the loops to retain the loops and act as mechanical amplifiers, as explained in more detail below.

Figure 9:
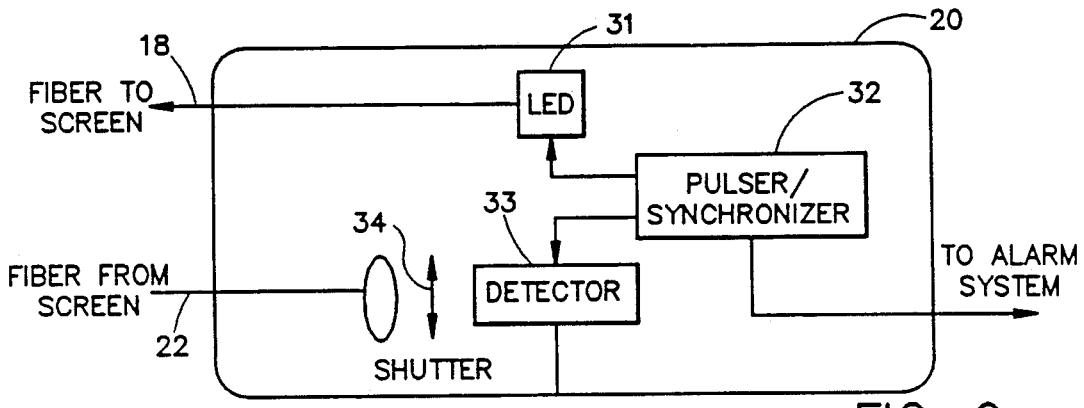
FIG. 9 is a block diagram of the electro-optical control unit for coupling the screen to a central alarm control unit.

The electro-optical module 20 is illustrated in more detail in FIG. 9 of the drawings and includes a light transmitter 31 such as a light emitting diode, a pulser/-synchronizer circuit 32 for controlling transmitter 31 to transmit a pulsed light signal into the end 18 of the optical fiber path in the screen, and a light detector 33 coupled to the opposite end 22 of the fiber path for detecting the light signal transmitted along the light path. As illustrated in FIG. 9, an opto-mechanical tamper switch or shutter 34 is mounted between the end 22 of the second fiber and the detector 33. Shutter 34 replaces the standard electrical reed switch used in electrical wire security screens to detect removal of the entire screen from a window or door frame, and is associated with a magnet (not illustrated in the drawings) which is mounted in the window or door frame. The magnet normally holds the shutter in an inoperative position out of the optical path. Although the opto-mechanical switch is illustrated between the end of the path and the detector, it may alternatively be positioned at any suitable location in the optical path, preferably within the frame 14. If the panel is removed from the window or door frame, the shutter will move to block the light beam from the fiber to the photodetector and thus activates the alarm in the event that the entire panel is removed from the frame.

Figure 10:
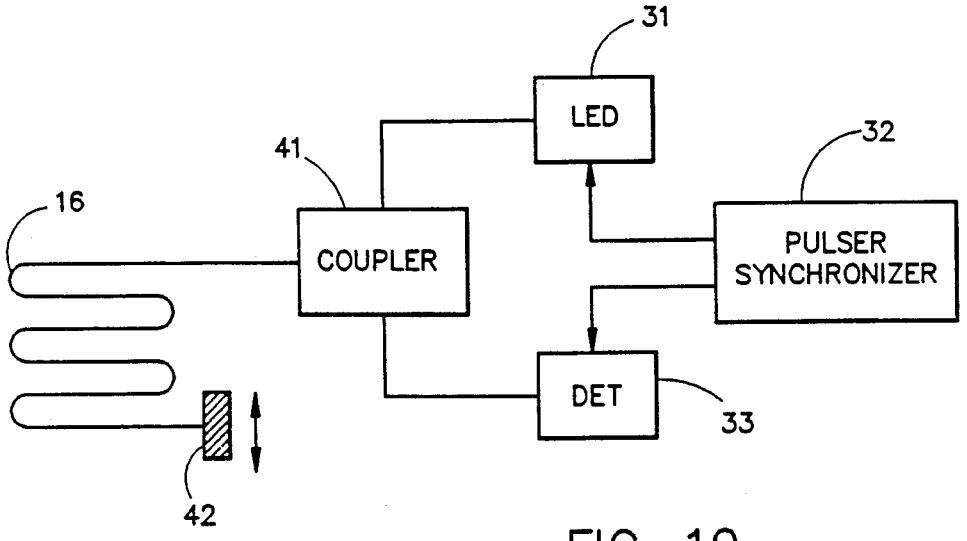
FIG. 10 illustrates a modification in which the detector and emitter are coupled to the same end of the optical path.

FIG. 10 illustrates a modification to the control module 20 and security screen. In this modification, the continuous optical path of one or more fibers interwoven with the screen material is connected at one end via a suitable optical coupler 41 to both the emitter 31 and the detector 33. A mirror 42 is coupled to the opposite end of the fiber path to reflect light transmitted along the path back to the detector. The mirror may act as a shutter, replacing shutter 34, and be mounted to be moved between a position facing the end of the optical path and a position out of alignment with the path if the panel is removed from the window or door frame. As in the case of shutter 34, mirror 42 is associated with a magnet mounted in the window or door frame, which normally holds it in its operative or reflecting position. The mirror will be biassed into an offset, non-reflecting position if moved away from the magnet, resulting in activation of the alarm. In this embodiment, the electro-optical module may be mounted in the alarm control unit or panel, if desired, with an optical fiber extending from the security panel to the control unit.

The pulser/synchronizer is designed to monitor the output from detector 33, which will be dependent on the intensity of the light beam detected, and to produce an alarm activating condition in the event that the intensity reduces to zero or below a predetermined level indicating breaking or a predetermined degree of distortion of the optical path. This circuit will be dependent on the design of the alarm system to which it is to be coupled. A preferred embodiment of the circuit for use with an existing alarm system of the type used for monitoring standard electrical wire security screens is described below in more detail in connection with FIG. 12.

In each of the security panel embodiments of FIGS. 1 and 2, the screen is mounted on a peripheral frame 14, as best illustrated in FIGS. 6 to 8. Frame 14 is in two parts, comprising a generally channel shaped lower member or base 43 and an upper part or cover 44 which is a snap fit on base 43. The frame 14 may be made in separate upper and lower segments for fitting over the upper and lower edges of the screen, with separate side segments for connecting the upper and lower segments together. However, in the preferred embodiment of the invention each frame part is a continuous rectangular member designed to extend around the entire periphery of the screen. In order to attach the screen material to the frame, the outer periphery of the screen material is first attached to a fabric spline 46 which is a snap fit in a groove 48 extending around the outer periphery of the base 43. The remainder of base 43 basically comprises a channel 50 which is large enough to allow installation of the electro-optics module 20 and splice members 24 (if used), which will all be positioned within the channel 50 when spline 46 is fitted in groove 48, as illustrated in FIG. 8A. Channel 50 has a slightly curved outwardly projecting rim or face 52 at its inner edge, over which the screen material extends.

The upper member or cover 44 of the frame comprises a member of generally L-shaped cross section having a first or outer leg 54 with an inturned rim 56 along its free edge, and a downwardly facing slot 58 adjacent its opposite edge or corner defined by a downward projection or rib 60. The second or longer leg 62 of the cover member has a downturned rim 64 at its free edge corresponding to the inner edge of the frame, and an additional rib 66 extends parallel to rim 64 to define a slot 68 for retaining cover spline 70, which is of a suitable elastic or resilient material such as rubber or the like. When the edge of the screen has been mounted on the frame base as illustrated in FIGS. 6 and 8A, the cover is fitted over the base with the slot 58 engaging over the outer rim 72 of groove 48 and the inturned rim 56 engaged over the lower corner of the base, as illustrated in FIGS. 8B and 8C. At this point the spline 70 is forced into the slot 68 between the cover and curved surface of the base, urging the cover into interlocking engagement with the base. The screen material is held where it enters the frame between a gently curved surface 52 on one side and an elastic spline 70 on the other side. It can be seen that this will avoid any sharp flexing of the optical fibers as they enter the frame, and reduces the risk of fatigue or failure of the fibers which would result in a malfunction of the system. The frame forms a compact unit which protects its contents from physical damage and can be made weather tight with suitable sealing. The frame may be of metal or plastics material. The interlocking parts of the frame are held in engagement by the elasticity of spline 70 which forces the outer edge 56 of the cover into tighter engagement over the outer edge of base 42.

As an alternative to installation of the screen fabric onto a frame, bars of the fabric may be cast into a solid bar at the top and bottom edges of the screen of plastic or other moldable material to encase the edges of the screen including the splices (if used), the break loops and the electro-optics module. The resultant assembly may then be installed onto an existing frame by gluing or mechanically securing the bars to the frame members.

Figure 11A:
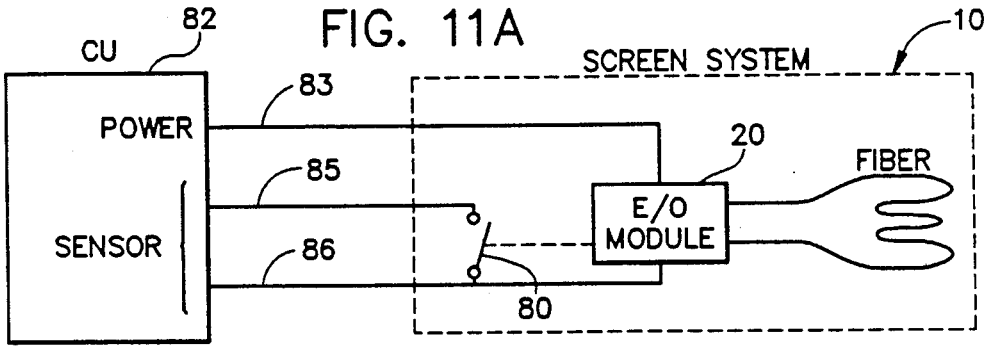
FIGS. 11A, 11B and 11C illustrate three alternative techniques for providing power to the security screen operating unit.
Figure 11B:
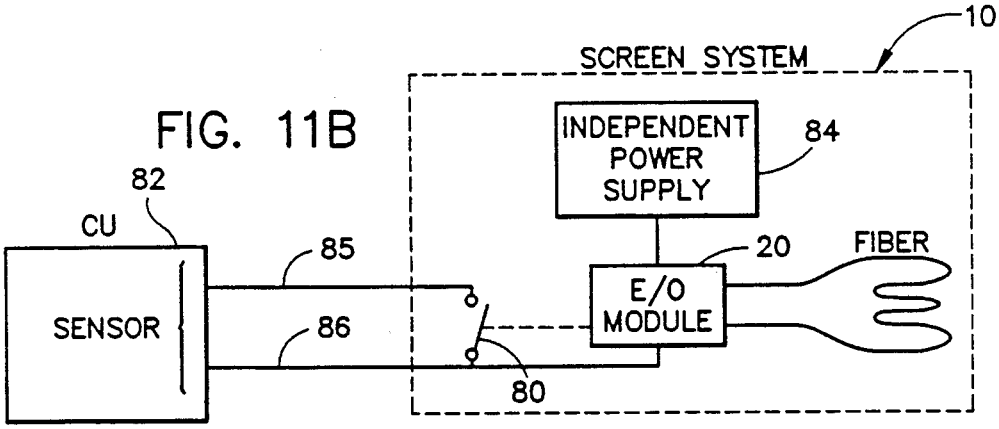
Figure 11C:
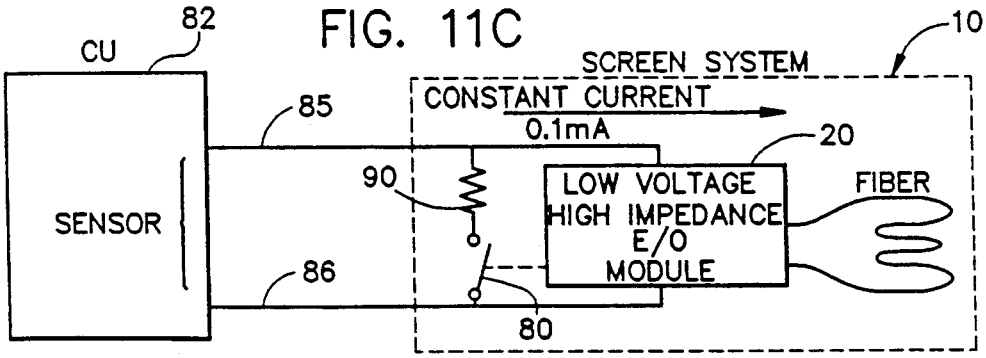

The interface or electro-optics unit 20 for coupling the screen to a central alarm control unit to activate the alarm if the detected signal is reduced below a predetermined level will now be described in more detail with reference to FIGS. 9 to 12. The unit 20 is designed both to control the emitter 31 to emit the desired pulsed light signal, and to monitor the detector output in synchronism with the pulsed light signal in order to activate an alarm signal at the remote control unit if the detected signal falls below a predetermined level corresponding to either breaking of the fibers or bending of the fibers beyond predetermined limits. In the preferred embodiment of the invention the unit is designed for connection to an existing alarm system in place of conventional electrical wire screens. Such systems are designed to provide an alarm if an open circuit condition is detected, indicating that one of the wires has been broken. Thus, the electro-optics unit includes a switch which is normally closed but which is opened in the event that the detected light signal falls to zero or to below a predetermined limit, the unit having outputs connected across the switch for connection to the inputs of an alarm control unit. FIGS. 11A, 11B, and 11C illustrate three alternative techniques for connecting a suitable switch 80 for activating an alarm between the electro-optics unit 20 and a central alarm or security control unit 82 to produce the desired alarm signal.

Modern central security control units have specified interface requirements for any sensor connected to them. Typically, a security sensor connected to a zone loop output on such a control unit is allowed to draw 2 to 3 mA of current from the unit and to have a total of 2 to 3 volts drop summed across the sensor and any connecting electrical cable.

The electro-optics unit of the security screen described above can interface to an existing central security control unit 82 by placing switch 80 where a wire screen is normally connected. The problem with this is that existing wire screens require no power input, whereas the electro-optics unit does require power. Thus, the placing of the switch between the control unit and the circuitry needed both to optically excite the light emitter and to monitor the status of the optical fibers in the screen complicates the powering of the circuitry. If the switch were to be simply placed in parallel with the electro-optics unit, there would be zero voltage across the module when the switch was closed. If it were placed in series with the module, zero current would flow when the switch opened. FIGS. 11A to 11C illustrate some alternative solutions to this problem.

Figure 12:
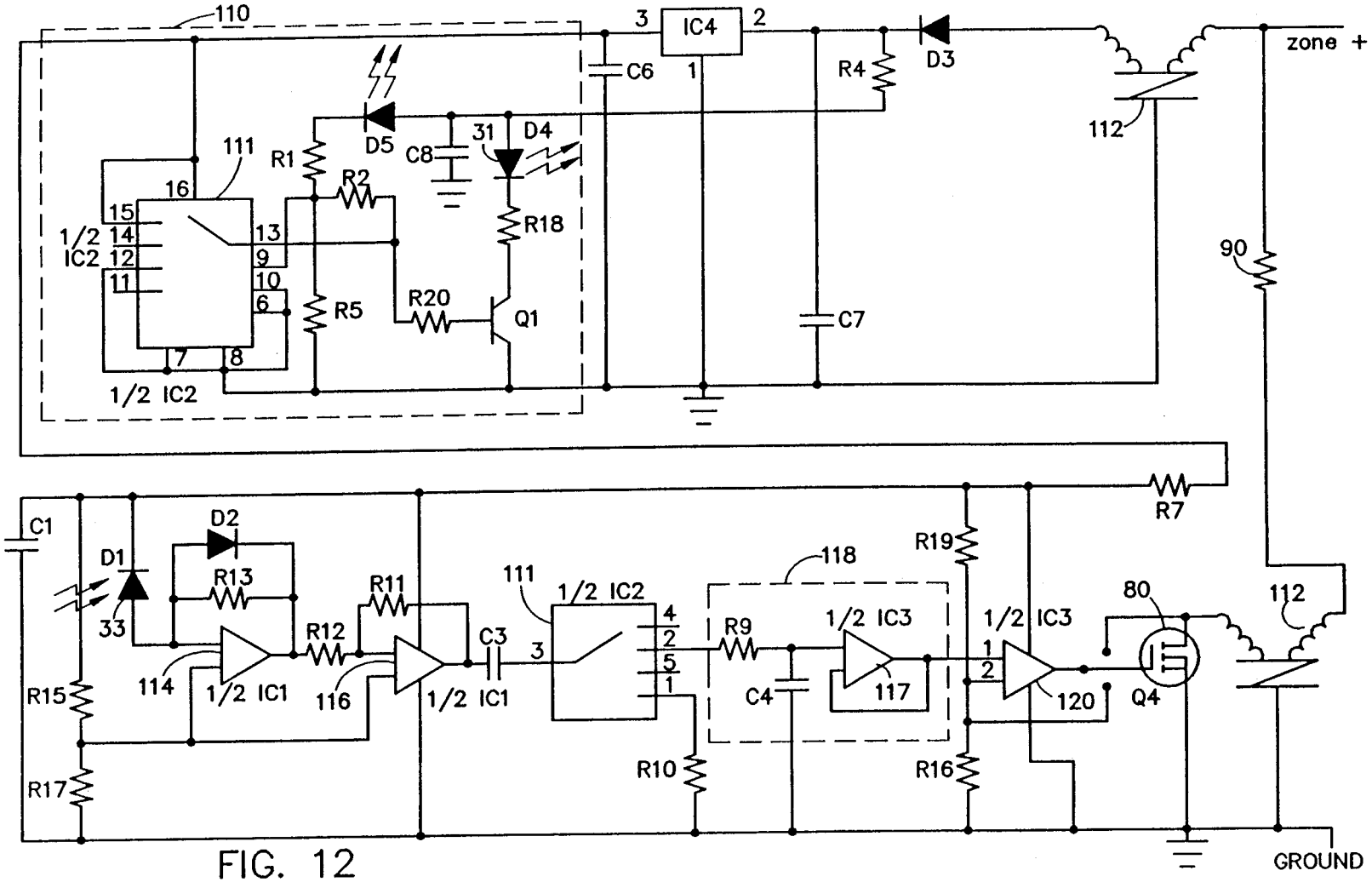
FIG. 12 is a more detailed schematic of a preferred version of the control unit of FIG. 9.

As illustrated in FIG. 11A, power to the electro-optics unit could be obtained from the central control unit itself by running a third wire 83 from the auxiliary power output of control unit to the screen. Alternatively, as illustrated in FIG. 11B, power could be obtained from an independent power source 84 such as a battery, mains input, or solar cell. The third technique illustrated in FIG. 11C utilizes special electronic circuitry in the electro-optics unit itself to power the unit via the existing two wire sensor or zone input 85,86 of the control unit. FIG. 12 is a schematic illustrating a preferred embodiment of the electro-optic unit 20 used in this version. The electro-optic unit 20 of FIG. 11C and 12 is designed to operate over a wide voltage range, typically from 2 to 12 Volts, and acts as a high impedance device that sinks a small constant current, typically 0.1 mA. As illustrated in FIG. 11C, a resistor 90 or other suitable voltage drop device, such as a diode, is connected in electrical series with switch 80 and the remainder of the electro-optics unit circuitry is placed in electrical parallel with the diode/switch combination. The diode or voltage drop device 90 is selected to drop a voltage equivalent to the source voltage or zone voltage of the security panel. This will be selected according to the particular security system with which the screen is to be used. In one specific example, the resistor 90 was selected to drop approximately 2 to 3 Volts regardless of the current.

When switch 80 is closed, the resistor/switch approximates a short circuit sinking the 2 to 3 mA normally drawn from the central control unit. The voltage across the module goes no lower than 2 to 3 volts, which is sufficient to power the electro-optics unit but sufficiently small for the central alarm or security control unit to measure a short circuit and establish that all is secure. If the fiber is broken, the switch opens and the large current through the switch ceases. The high impedance electro-optics module still draws its needed current but this is sufficiently small for the central control unit to measure large resistance, establish that the sensor is off, and signal an alarm. The electro-optics unit has an internal voltage regulator circuit so that it can operate with any open circuit voltage provided by the central alarm control unit, e.g. 2 to 12 Volts.

FIG. 12 is a schematic illustrating one possible example of a circuit designed according to the technique illustrated in FIG. 11C. It will be understood by those skilled in the field that alternative circuits may be designed to perform an equivalent function. The circuit simultaneously uses the same security panel zone sensor and ground terminals both for interfacing the alarm signal to the security system panel and obtaining electrical power. This is possible because the circuit operates on a low voltage and requires very little supply current.

As illustrated in FIG. 12, the circuit includes an emitter section, illustrated in the upper half of the drawing, and a receiver section, illustrated in the lower half of the drawing. The emitter section is designed to produce pulses of light at emitter or LED 31 for transmission along the optical fiber path in the screen. Since pulses of light are emitted, rather than a continuous light beam, power is conserved. In a preferred embodiment of the invention, the pulse rate is 5 to 10 pulses per second with a duty cycle of about 0.1% (on time as compared to off time). Light pulses are produced using an astable multi-vibrator circuit 110, which basically comprises the emitter LED 31, a large capacitor C8, a transistor Q1, a CMOS analog gate 111 used as a switch, and various resistors R1,R2,R5,R16 and R20. The power input V+ is connected through surge suppressor 112, diode D3, and resistor R4 to the capacitor C8. The power input is connected through voltage regulator IC4 to the CMOS switch.

When the transistor Q1 is off, the capacitor C8 is charged through resistor R4. Charging continues until the capacitor voltage into the CMOS analog gate control pins causes the gate to change state. This turns on the transistor Q1 and discharges the capacitor through the emitter LED, producing a light pulse in the optical fiber. Once the capacitor voltage falls to a level determined by the hysteresis resistors (R1,R2,R5,R20) connected to the CMOS gate control pins, the gate changes state again, and the transistor turns off, causing the LED 31 to turn off. The capacitor then starts to charge again, and the cycle continues.

The receiver section of the circuit uses half of the same CMOS gate 111 as the emitter section, ensuring perfect timing independent of any drifts. In one particular example the CMOS gate was a CD 4052 IC. The detector 33 comprises a PIN diode but other photoconductive or photovoltaic detectors can be used, e.g. phototransistors. The detector 33 is connected to two operational amplifiers 114,116 which convert the current emitted by detector 33 in response to detection of light emitted from the fiber path into a voltage, and then amplify that voltage. The amplified voltage is connected to a subtraction circuit comprising the other half of the same CMOS gate 111 used in the emitter part of the circuit. The control signals for the astable multivibrator switch 111, which control the switching of LED 31 on and off, simultaneously control the detector part of the circuit. When the LED 31 is off, the CMOS gate is switched to pin 1, so that any voltage output from the operational amplifiers is connected through isolation capacitor C3 and resistor R10 to ground. Thus, capacitor C3 stores the "light off" voltage level. When LED 31 is turned on, the CMOS gate is switched to pin 2, connecting capacitor C3 in series with low pass filter 118. As a result, the "light off" voltage is effectively subtracted from the "light on" voltage, so that the amplitude of the light pulse alone is averaged and stored by the low pass filter 118. Amplifier 117 has a high input impedance to act as a voltage buffer limiting charge leakage on the capacitor.

The output of low pass filter 118 is connected to one of the inputs of amplifier 120, which is used as a comparator, while the voltage at the other input is controlled by a voltage divider comprising resistors R16 and R19. This is determined by the desired level at which alarm activation is desired, and is selected to avoid inadvertent actuation of the alarm due to normal everyday use of the screen, for example as a result of objects impacting the screen. The output of comparator or amplifier 120 is connected to an FET Q4, which is equivalent to switch 80 in FIG. 11C. If the voltage at input 1 is higher than that at input 2, the amplifier 120 is on and the FET will also be on, or conducting. The security system control panel will therefore detect a closed circuit condition. If the voltage at input 1 falls below that at input 2, indicating that the light pulse expected at the detector is either not there or is below a predetermined level indicating bending of the fiber path beyond a predetermined amount, the amplifier 120 turns off. The FET Q4 simultaneously turns off, and the security system control panel detects an open circuit condition, initiating the alarm.

The values of the various components in the emitter circuit will depend on the pulse rate and duty cycle required. In one specific example, capacitor C8 was 47 Microfarads, C7 was 20 Microfarads, R1 was 62KOhms, R2 was 680 KOhms, R5 was 390KOhms, R20 was 2.2 KOhms, R18 was 22 Ohms, and R4 was 20KOhms. The values of the various components in the receiver section are selected according to the desired signal level at which the alarm signal is to be activated, and other criteria. In the same example for which the emitter section component values are given above, the various receiver section components were as follows: C1=0.047 Microfarads; C3=2.2 Microfarads; C4=0.01 Microfarads; R7=10 KOhms; R15=2 MOhms; R17=220KOhms; R13=2 MOhms; R12=220KOhms; R16=10KOhms; and R19=300 KOhms.

The circuit arrangement of FIG. 12 is arranged to allow powering of the unit as well as signaling of an alarm condition via the existing two wire sensor input (or zone input) of an alarm control unit or panel. Thus, as in FIG. 11C, a resistor 90 is connected in series with FET Q4 across the ground and alarm input wires. There will be a source voltage typical of the particular alarm system at the alarm input, which can be used to power the electro-optical circuitry as indicated in FIG. 12. Resistor 90 is selected to match the source voltage and impedance. For example, say the source voltage was 5 Volts and the source had an internal resistance of 1000 ohms dropping the voltage to 2.5 Volts. Resistor 90 will then be selected to be 1000 ohms. Since the circuit operates on very low power, resistor 90 and FET Q4 act as a short circuit when FET Q4 is on, so that the alarm control unit measures 2.5 Volts at the sensor input, indicating that all is secure. When FET Q4 opens, a signal of 5 volts will be measured at the sensor input, indicating an open circuit condition and initiating the alarm. In either case, sufficient voltage will be present at the power input to the circuit to power the electro-optics circuitry.

The circuitry of FIG. 12 could also be operated on three wires, as in FIG. 11B and 11C, if desired. In this case, the resistor 90 connecting power input V+ to the FET will be connected to a separate alarm detection circuit, and the power input will be connected either to an independent power source or to an auxiliary power output of the security panel itself. Transient voltage suppressors 112 are placed at the connection points of each line to shut out potentially damaging interference or excessive voltages.

Since the detection of the pulsed output from the fiber path is synchronous with the pulses emitted from the LED, the immunity of the system to electrical and optical noise or drifts is greatly improved. Perfect timing is ensured by using the same switch unit (CMOS switch 111) in both the emitter and the receiver part of the circuit. The unit also has very low power consumption, allowing long period battery operation if it uses its own internal battery source and also allowing it to be powered directly from an existing alarm system if desired.

Although the electro-optical module 20 is particularly intended for integrating fiber optic security screens as illustrated in FIG. 1 to 8 with an existing alarm system, it may be used with any fiberoptic loop sensor.

Figure 13:
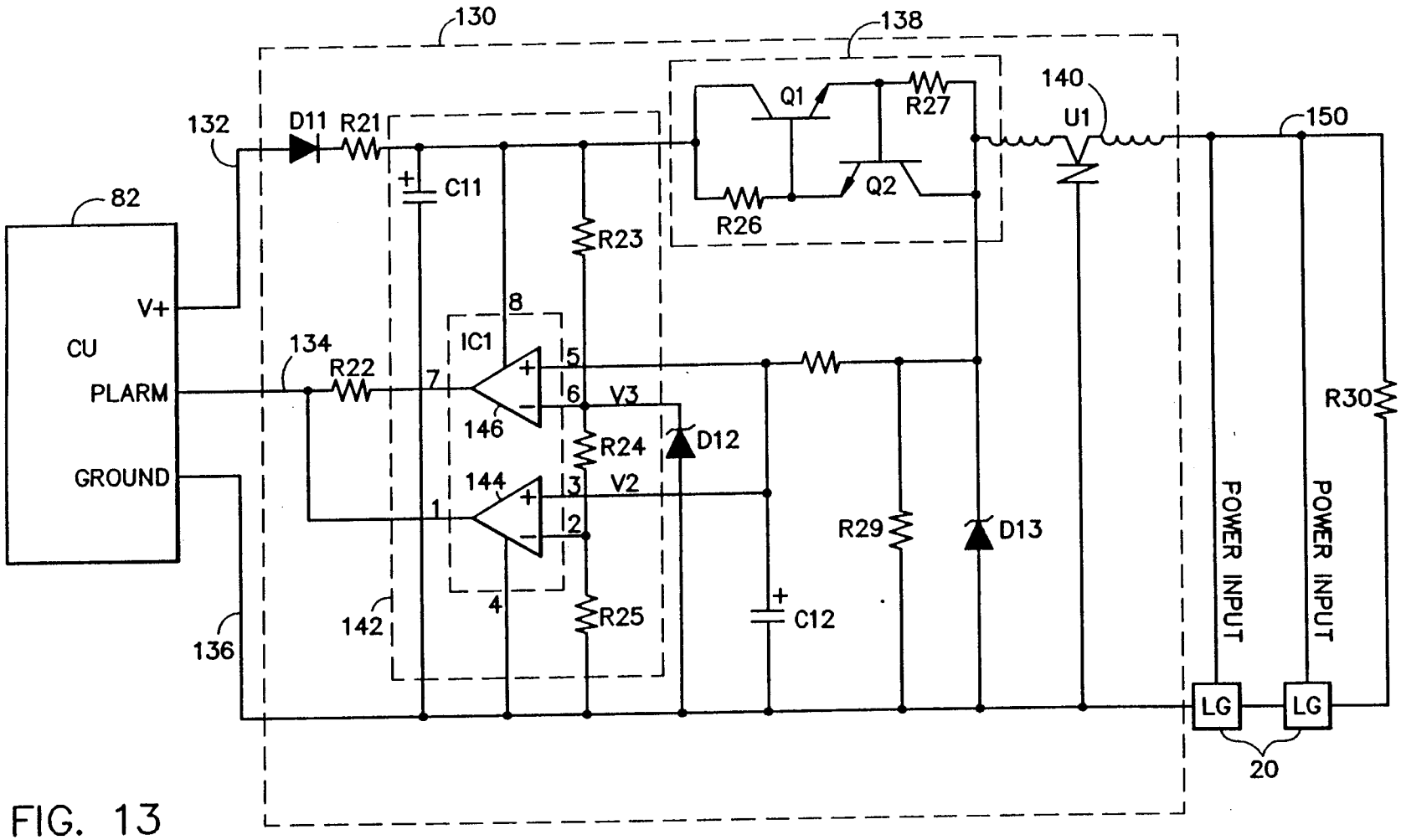
FIG. 13 is a schematic illustrating a module for coupling several security screens to a single central alarm control unit.

The system has been described above for a single security screen. However, in practice, a security system for a building will include a number of security screens covering window and door openings, all of the screens being linked via hard wiring or other signal transmission means to a central alarm control unit for activating an alarm if any unit is tampered with. In the case of electrical wire screens, the screens are simply connected in series with the control unit so that an open circuit condition is detected if any wire is broken. However, this is not possible with the optical fiber screens and electro-optical units as described above due to their power requirements. FIG. 13 illustrates a line interface module 130 for connecting a series of electro-optical units 20, each connected to a separate optical fiber security screen, to an alarm control unit 82. This arrangement allows up to ten units to operate on a two wire cable 150 connected to the line interface module. The line interface module is designed to provide a constant current to the units 20 and also to measure the voltage drop across the units to determine whether an alarm condition exists.

The low resistance switch or FET 80 of each electro-optical unit 20 is connected in series on the return line of the two wire cable, while a terminating resistor or a diode R30 is connected across the ends of the two wire cable. In a specific example the terminating resistor was 1KOhm.

The line interface module 130 has a power input 132 connected to the auxiliary power output of the alarm control unit panel to receive a power input in the form of a d.c. voltage, typically in the range from 10 to 15 volts. The module also has an alarm output 134 connected to the control panel zone sensor input, and a ground connection 136 to the control panel ground. The power input is connected via constant current source 138 through surge suppressor 140 to the power inputs of the electro-optical units. The constant current source maintains a constant current of around 7 to 8 mA, as determined by the value of resistor R27.

The remainder of the module comprises a comparator circuit 142 for detecting when the voltage across its inputs, and thus the voltage drop across the two line cable, is outside predetermined limits, indicating an alarm condition. The comparator circuit includes two comparators or amplifiers 144,146 for comparing the voltages at their respective inputs. The voltage V1 across the line is applied to the positive inputs of the two comparators, while control voltages V2 and V3 determined by the value of the diode D12 and resistances R24 and R25 of the voltage divider are connected to the negative inputs of comparator 144 and 146, respectively. When V1 is between the values V2 and V3, comparator 144 will be off while comparator 146 will be on, resulting in a Normal signal indication at the alarm unit control panel. If one of the switches in the electro-optical units opens, or if the cable itself breaks, the voltage V1 will go higher than V3, turning comparator 146 off and open circuiting the alarm input, resulting in an alarm condition at the alarm unit control panel. In the event of a short circuit shorting the cable voltage to zero, the voltage V1 will go lower than V2, turning comparator 144 on and connecting the alarm input to the cable return line 136, so that the alarm unit detects a "shorted cable" condition. In practice, the system will be set up to signal normal operation when the voltage drop across the cable is about equal to the voltage of the zone sense input circuit of the alarm control unit. In one specific example, the voltages V2 and V3 were selected to be 3.4 Volts and 6.8 Volts, respectively, by appropriate selection of the values of the resistances in the voltage divider.

The line interface module allows multiple electro-optical units to be connected to one "security zone" of an alarm control unit (i.e. the area served by one sensor input of the control unit). A single electro-optical unit may be connected directly to a control unit sensor input, while an interface module is required if more than one electro-optical unit is to be connected to the same sensor unit.

When normal everyday forces are applied against the screen, for example as a result of wind, objects such as balls thrown against the window, and so on, slack is taken up from the break loops at the end of each fiber. This permits the screen to be relatively insensitive to incidental forces resulting from everyday use, reducing the risk of false alarms. If the screen material is actually cut, the alarm will be activated. Additionally, when the force exerted on the screen exceeds a prescribed limit, as determined by the size of the break loops, the radius of one or more of the break loops will be pulled so small that the fiber snaps, activating the alarm. The tubes or mechanical amplifiers 30, if used, ensure that a loop is pulled through the tube and made smaller when force is exerted on the adjacent length of fiber. The force required to snap the fiber in this way is much less than that required to tear apart by pulling on its ends, increasing the sensitivity of the screen to forces above a prescribed limit.

The fiber optic security screen assembly described above is relatively inexpensive and easy to assemble. The screen is sensitive to attempts to cut or stretch a window or door screen, and is relatively insensitive to everyday forces such as are encountered by window and door screens in normal, everyday use. The optical fibers are interwoven with the screen material itself, making them resistant to dislodging and also less noticeable to an observer than fibers which are actually adhered or otherwise secured to an existing screen. Optical fibers typically have rugged coatings which protect them from the environment, so that they are resistant to corrosion and other environmental damage. They are also immune from electromagnetic interference and electrolytic corrosion, further reducing the risk of malfunction or false alarms.

The electro-optics module providing the interface from the screen to a central alarm control unit has low power consumption due to its pulsed, low duty cycle operation. The synchronous detection of the pulsed light output from the fiber greatly improves the immunity of the module to electrical and optical noise. It also makes the circuit less easy to "spoof" or defeat. The unit draws very little current and requires very low voltage to operate, resulting in low power consumption and the possibility of long period battery operation if an internal battery source is required. This also makes the unit compatible with the power supply capabilities of existing alarm systems. The signal output characteristics of the module are also directly compatible with existing alarm systems, so that an existing alarm system can be easily converted from wire screen sensors to this system simply by replacing each wire screen with a fiber optic security screen as described above, with no additional modifications to the system, thus reducing installation expense. The screens are physically compact, with the outer frame protecting the electrical circuitry and optical splices at the outer edges of the screen. The electrical connections and circuitry are preferably environmentally sealed.

Although the drawings illustrate a hard wired connection between the security panel and the central security control unit, they may alternatively be coupled via an optical or radio frequency link, for example, as is known in the field of security or alarm systems. In this case, the electro-optics unit will be designed to provide a suitable control signal to the central control unit in the event that the optical fiber is broken. Although a preferred embodiment of the invention has been described above by way of example only, it will be understood by those skilled in the field that modifications may be made to the disclosed embodiment without departing from the scope of the invention, which is defined by the appended claims.

What is claimed is:

1. A security screen assembly, comprising:

a screen of mesh material for covering a door or window opening;

the screen including a continuous optical path extending in a generally serpentine pattern across the screen, the path comprising at least one optical fiber integrally woven into the screen material;

light emitting means connected to the path for transmitting light through said optical path;

detector means connected to said path for detecting a light signal emitted from said path;

electro-optical interface means connected to said light emitting means and detector means for activating a remote alarm control unit if said detected light signal is below a predetermined intensity, said interface means including a switch, output means connected across said switch for connection to a remote alarm control unit for activating an alarm if said switch is open, and means for opening said switch if said detected light signal is below said predetermined intensity; and the optical path comprising a series of spaced, parallel optical fibers extending between opposite side edges of the screen, each fiber having a first end at one side edge of the screen and a second end at the opposite side edge of the screen, said light emitting means being connected to a first end of one of the fibers and said detector means being connected to a first end of a second, adjacent one of the fibers, and further including a series of spaced, arcuate optical splice means along each edge of the screen for connecting the remaining first ends of the fibers together in pairs and the second ends of the fibers together in pairs, respectively, to form a continuous, serpentine light path through all the fibers from the first end of the first fiber to the first end of the second fiber, said optical splice means comprising means for changing the direction of the light path at each turn in the serpentine light path.

2. The assembly as claimed in claim 1, wherein said optical interface means also includes means for operating said light emitting means to emit a pulsed light signal.

3. The assembly as claimed in claim 1, wherein said optical interface means, emitter means and sensor means are all mounted in a single electro-optical unit.

4. The assembly as claimed in claim 1, including a frame extending around the periphery of the screen, the outer edges of the screen being secured in the frame.

5. The assembly as claimed in claim 4, wherein said optical path extends in a generally serpentine path back and forth between opposite first and second edges of the screen, and at least the edges of the frame retaining said first and second edges of the screen comprise a base member and a cover member releasably secured to the base member to retain said screen edges between said members.

6. The assembly as claimed in claim 5, wherein said base member has a channel for receiving said light emitting means, said detector means, and turns in said serpentine optical path.

7. The assembly as claimed in claim 6, wherein said channel further comprises means for holding said interface means.

8. The assembly as claimed in claim 1, including pulse generating means for operating said emitter means to produce a pulsed light signal.

9. The system as claimed in claim 8, wherein the detector means is linked to said pulse generating means for detecting light pulses in synchronism with the emission of pulses by said emitter means.

10. The assembly as claimed in claim 1, wherein said output means includes only two lines for connection to sensor inputs of said alarm control unit to provide power to the electro-optical interface means from said alarm control unit and to provide an alarm signal to said alarm control unit, and voltage drop means connected in series with said switch means across said lines.

11. The assembly as claimed in claim 1, including a plurality of said security screens, each screen having an associated light emitting means for transmitting light along its optical path, detecting means for detecting light emitted from its path, and electro-optical interface means, the switches in said electro-optical interface means being connected in series, and a line interface module connected between said alarm control unit and said electro-optical interface means comprising means for distributing power to said interface means and for relaying an alarm condition in any one of said electro-optical interface means to said alarm control unit.

12. A security screen assembly, comprising:

a screen of mesh material for covering a door or window opening;

the screen including a continuous optical path extending in a generally serpentine pattern across the screen, the path comprising at least one optical fiber integrally woven into the screen material;

light emitting means connected to the path for transmitting light through said optical path;

detector means connected to said path for detecting a light signal emitted from said path;

electro-optical interface means connected to said light emitting means and detector means for activating a remote alarm control unit if said detected light signal is below a predetermined intensity, said interface means including a switch, output means connected across said switch for connection to a remote alarm control unit for activating an alarm if said switch is open, and means for opening said switch if said detected light signal is below said predetermined intensity; and optical coupling means for coupling a first end of said optical path to both said emitting means and said detector means, and reflector means at the opposite end of said optical path for reflecting light signals transmitted along the path back to the first end of said path.

13. A security screen assembly, comprising:

a screen of mesh material for covering a door or window opening;

the screen including a continuous optical path extending in a generally serpentine pattern across the screen, the path comprising at least one optical fiber integrally woven into the screen material;

light emitting means connected to the path for transmitting light through said optical path;

detector means connected to said path for detecting a light signal emitted from said path;

electro-optical interface means connected to said light emitting means and detector means for activating a remote alarm control unit if said detected light signal is below a predetermined intensity, said interface means including a switch, output means connected across said switch for connection to a remote alarm control unit for activating an alarm if said switch is open, and means for opening said switch if said detected light signal is below said predetermined intensity; and said optical path including optical fiber portions at least at one side edge of the screen which are looped to cross over themselves to form break loops of predetermined radius larger than the fiber minimum bend radius.

14. The assembly as claimed in claim 13, wherein a single continuous fiber is woven into the screen material to form said optical path.

15. The assembly as claimed in claim 13, wherein said emitting means is coupled to a first end of said fiber and said detector means is coupled to the second, opposite end of said fiber.

16. The assembly as claimed in claim 13, wherein break loops are formed at each bend in the optical path.

17. A security screen assembly, comprising:

a screen of mesh material for covering a door or window opening;

the screen including a continuous optical path extending in a generally serpentine pattern across the screen, the path comprising at least one optical fiber integrally woven into the screen material;

light emitting means connected to the path for transmitting light through said optical path;

detector means connected to said path for detecting a light signal emitted from said path;

electro-optical interface means connected to said light emitting means and detector means for activating a remote alarm control unit if said detected light signal is below a predetermined intensity, said interface means including a switch, output means connected across said switch for connection to a remote alarm control unit for activating an alarm if said switch is open, and means for opening said switch if said detected light signal is below said predetermined intensity;

a frame extending around the periphery of the screen, the outer edges of the screen being secured in the frame;

said optical path extending in a generally serpentine path back and forth between opposite first and second edges of the screen, and at least the edges of the frame retaining said first and second edges of the screen comprising a base member and a cover member releasably secured to the base member to retain said screen edges between said members; and said frame including means at its outer edge for retaining the outer first and second edges of said screen material, and means at its inner edge for retaining portions of the or each optical fiber, said means at its inner edge comprising opposing surfaces on said base and cover members, one of said surfaces being curved and the other surface being of resilient material.

18. A method of manufacturing a security screen, comprising the steps of:

weaving a length of screen material; and interweaving at least one optical fiber into the woven screen material at spaced intervals;

the step of interweaving the optical fiber comprising:

tying one end of an optical fiber to an end of one strand of the woven material at one edge of the screen;

pulling the opposite end of the strand to pull the strand out of the screen and pull the fiber through the screen to its opposite edge along the path followed by the strand;

detaching the first strand from the fiber and tying the fiber to the end of a second, spaced strand at said opposite edge;

pulling the opposite end of the second strand at said one edge of the screen to pull that strand out of the screen and pull the fiber back through the screen material; and repeating the procedure until the fiber extends in a serpentine path interwoven with the screen material across the entire screen.

* * * * *